US011421849B2

(12) United States Patent
Kim

(10) Patent No.: US 11,421,849 B2
(45) Date of Patent: Aug. 23, 2022

(54) LAMP FOR AUTOMOBILE AND AUTOMOBILE INCLUDING THE SAME

(71) Applicant: HYUNDAI MOBIS CO., LTD., Seoul (KR)

(72) Inventor: Seok Huyn Kim, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/489,526

(22) Filed: Sep. 29, 2021

(65) Prior Publication Data

US 2022/0128213 A1 Apr. 28, 2022

(30) Foreign Application Priority Data

Oct. 26, 2020 (KR) ..... 10-2020-0139709

(51) Int. Cl.
*F21S 43/20* (2018.01)

(52) U.S. Cl.
CPC ..... *F21S 43/26* (2018.01)

(58) Field of Classification Search
CPC ..... F21S 43/26; G09F 19/125
See application file for complete search history.

(56) References Cited

U.S. PATENT DOCUMENTS

| | | | | |
|---|---|---|---|---|
| 9,074,744 | B2 * | 7/2015 | Tsukamoto | F21S 43/245 |
| 2017/0059113 | A1 * | 3/2017 | Gloss | F21S 43/241 |
| 2020/0300434 | A1 * | 9/2020 | Gloss | F21S 43/14 |
| 2021/0132543 | A1 * | 5/2021 | Han | G02B 5/32 |
| 2021/0148538 | A1 * | 5/2021 | Allen | F21S 41/50 |
| 2021/0382321 | A1 * | 12/2021 | Khayat | F21S 43/26 |
| 2022/0003382 | A1 * | 1/2022 | Kim | F21S 43/14 |

* cited by examiner

*Primary Examiner* — Bryon T Gyllstrom
*Assistant Examiner* — Christopher E Dunay
(74) *Attorney, Agent, or Firm* — DLA Piper LLP (US)

(57) ABSTRACT

A lamp for an automobile and an automobile including the lamp. According to the present disclosure, among the light emitted from a light source, light incident into an inner lens through one side surface of the inner lens forms a first lighting image and a second lighting image having a different shape from the first lighting image. The first lighting image and the second lighting image are determined depending on a region of the inner lens through which the light is emitted out.

18 Claims, 5 Drawing Sheets

LAMP FOR AUTOMOBILE AND AUTOMOBILE INCLUDING THE SAME

CROSS-REFERENCE TO RELATED APPLICATION(S)

This application claims priority from and the benefit of Korean Patent Application No. 10-2020-0139709, filed on Oct. 26, 2020, which is hereby incorporated by reference for all purposes as if set forth herein.

TECHNICAL FIELD

Exemplary embodiments relate to a lamp for an automobile and an automobile including the lamp and, more particularly, to a lamp for an automobile, capable of producing a lighting image having a three dimensional shape, and an automobile including the lamp.

BACKGROUND

As demands of consumers on the aesthetic impression of lamps for an automobile increase in addition to basic functions of the lamps such as providing visibility to drivers or providing various information about travel conditions of the automobile to the outside, research on lamps for an automobile, having various types of lighting images, has been actively conducted. As one example, special lenses capable of producing lighting images having 3D shapes have been applied to the lamps for an automobile.

However, according to the related art, even though such a special lens is applied to the lamp for an automobile, the lighting images having the 3D shapes are not sufficiently produced. In addition, the characteristics of the special lens are not appropriately utilized, and thus, the overall light emitting efficiency of the lamp including the special lens is deteriorated.

SUMMARY

Exemplary embodiments of the present invention provide a lamp for an automobile, capable of producing a lighting image having a 3D shape more effectively than in the related art.

A first exemplary embodiment of the present invention provides a lamp for an automobile, the lamp including: a light source configured to emit light; and an inner lens having one surface that faces the light source, wherein the inner lens is disposed in a horizontal direction such that main planes of the inner lens having large areas face upward and downward, and the light source faces one side surface of the inner lens in the horizontal direction, wherein, among the light emitted from the light source, light, which is incident into the inner lens through the one side surface of the inner lens and then emitted out through the other side surface of the inner lens on the opposite side from the one side surface, forms a first lighting image, wherein, among the light emitted from the light source, light, which is incident into the inner lens through the one side surface of the inner lens and then emitted out through an upward facing main plane of the main planes of the inner lens, forms a second lighting image having a shape different from that of the first lighting image.

The first lighting image may have a 2D image, and the second lighting image may have a 3D image.

The inner lens may include: a first inner lens provided in a lower region of the inner lens; and a second inner lens which is provided above the first inner lens and provided in close contact with the first inner lens, wherein the first lighting image is formed by light which, among the light emitted from the light source, is incident into the second inner lens through one side surface of the second inner lens and then emitted out through the other side surface of the second inner lens on the opposite side from the one side surface.

The second lighting image may be formed by light which, among the light emitted from the light source, is incident into the second inner lens through the one side surface of the second inner lens and then emitted out through a top surface of the second inner lens.

The second inner lens may be a lenticular lens.

The lamp may further include a first support member which is provided below the first inner lens and provided in close contact with the first inner lens.

The first inner lens may include: a body portion constituting a body of the first inner lens; and a downward protruding portion which is provided at a front end of the body portion and protrudes downward, wherein a front end of the first support member is provided in close contact with a rear surface of the downward protruding portion.

The first inner lens may further include a forward protruding portion which is provided on a front surface of the downward protruding portion and protrudes forward, wherein the lamp further includes a second support member provided below the first support member, and at least a partial region of the second support member is provided in close contact with the forward protruding portion.

The second support member may be provided in close contact with a front surface and a top surface of the forward protruding portion.

The second support member may be provided in close contact with the front surface of the downward protruding portion.

A top surface of the first inner lens may be bonded to a bottom surface of the second inner lens.

The top surface of the first inner lens may be bonded to the bottom surface of the second inner lens by a double-sided tape.

Both ends of the first inner lens in the horizontal direction may cover a portion of both side surfaces and a portion of a top surface of the second inner lens.

The lamp may further include a reflector provided above the second inner lens, wherein a rear end of the second inner lens is inserted into a space formed between a rear end of the reflector and a rear end of the first inner lens.

The first inner lens may further include an upward protruding portion which is provided at the rear end of the first inner lens and protrudes upward toward the reflector, wherein the second inner lens is provided in close contact with a front surface of the upward protruding portion.

A light input portion, which is the one side surface of the second inner lens facing the light source, may include a concave region so that the light emitted from the light source is diffused.

A light input portion, which is the one side surface of the second inner lens facing the light source, may include a convex region so that the light emitted from the light source is converged and then diffused.

A second exemplary embodiment of the present invention provides an automobile including a lamp for the automobile, wherein the lamp includes: a light source configured to emit light; and an inner lens having one surface that faces the light source, wherein the inner lens is disposed in a horizontal direction such that main planes of the inner lens having large areas face upward and downward, and the light source faces one side surface of the inner lens in the horizontal direction, wherein, among the light emitted from the light source, light, which is incident into the inner lens through the one side surface of the inner lens and then emitted out through the other side surface of the inner lens on the opposite side from the one side surface, forms a first lighting image, wherein, among the light emitted from the light source, light, which is incident into the inner lens through the one side surface of the inner lens and then emitted out through an upward facing main plane of the main planes of the inner lens, forms a second lighting image having a shape different from that of the first lighting image.

The lamp may be provided on the rear of the automobile.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, a lamp for an automobile and the automobile according to the present disclosure will be described with reference to the drawings.

Lamp for Automobile

Figure 1:
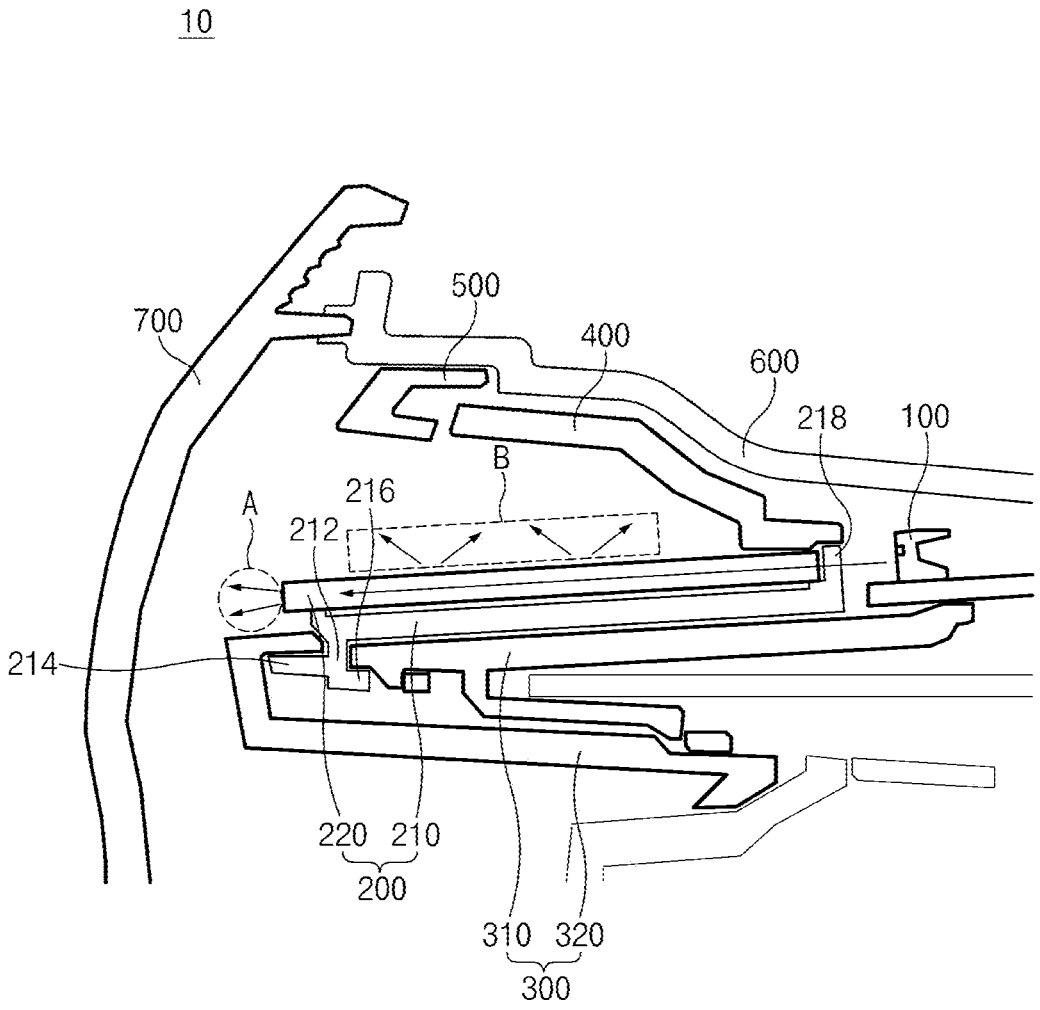
FIG. 1 is a cross-sectional view illustrating a schematic structure of a lamp for an automobile according to the present disclosure.

FIG. 1 is a cross-sectional view illustrating a schematic structure of a lamp for an automobile according to the present disclosure.

As illustrated in FIG. 1, a lamp 10 for an automobile (hereinafter, referred to as a 'lamp') according to the present disclosure may include a light source 100 emitting light forward; and an inner lens 200 having one surface that faces the light source 100. The types of the light source 100 are not limited, but as one example, the light source 100 may be an LED.

Meanwhile, the inner lens 200 may be disposed in a horizontal direction such that main planes of the inner lens 200 face upward and downward. Here, the main planes may represent surfaces that have relatively large areas among the plurality of surfaces formed around the inner lens 200. Thus, that the inner lens 200 is disposed in the horizontal direction such that the main planes face upward and downward may represent that the inner lens 200 is disposed while lying in the horizontal direction. In this case, the lamp 10 may be reduced in size in the up-down direction, and thus, the lamp 10 may have a slimmer shape than that in the related art.

Meanwhile, the light source 100 may face a relatively small surface of the inner lens 200. Thus, the light source 100 may face one side surface of the inner lens 200 in the horizontal direction. More preferably, the light source 100 may face a rear side surface of the inner lens 200 as illustrated in FIG. 1.

Meanwhile, the lamp 10 according to the present disclosure may form lighting images having different shapes, depending on which surface of the inner lens 200 the light, which has been emitted from the light source 100 and then incident into the inner lens 200, is emitted to the outside through. Thus, according to the present disclosure, the lighting image of the lamp 10 may be changed according to the positions from which the lamp 10 is viewed. Here, the lighting image may represent an image of the lamp 10 recognized by the eyes of a person when the person views the lamp 10 from the outside in a state in which the light source 100 is turned on.

More specifically, according to the present disclosure, among the light emitted from the light source 100, light, which is incident into the inner lens 200 through the one side surface (for example, the rear side surface) of the inner lens 200 and then emitted out through the other side surface (for example, the front side surface) of the inner lens 200 on the opposite side from the one side surface, may form a first lighting image. Also, among the light emitted from the light source 100, light, which is incident into the inner lens 200 through the one side surface (for example, the rear side surface) of the inner lens 200 and then emitted out through an upward facing main plane (that is, the top surface of the inner lens) of the main planes of the inner lens 200, may form a second lighting image having a shape different from that of the first lighting image.

Figure 4:
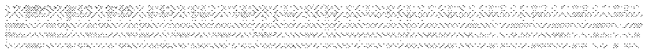
FIG. 4 is a view illustrating one example of a first lighting image which is formed by light emitted through a front side surface of a second inner lens in a lamp for an automobile according to the present disclosure.
Figure 5:
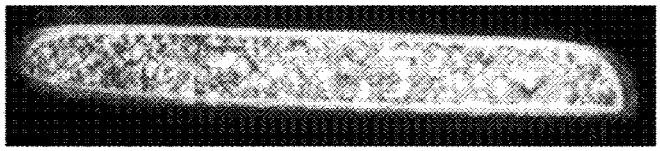
FIG. 5 is a view illustrating one example of a second lighting image which is formed by light emitted through an upward facing main plane of a second inner lens in a lamp for an automobile according to the present disclosure.

More preferably, the first lighting image may have a 2D image, and the second lighting image may have a 3D image. FIGS. 4 and 5 illustrate examples of the first lighting image and the second lighting image. Here, whether the lighting image is the 2D image or the 3D image may be determined on the basis of whether a person viewing the lamp 10 recognizes the image as a 2-dimensional image or a 3-dimensional image. Hereinafter, the configuration of the lamp 10 according to the present disclosure to produce a lighting image will be described.

As illustrated in FIG. 1, the inner lens 200 of the lamp 10 according to the present disclosure may include a plurality of components. More specifically, the inner lens 200 may include: a first inner lens 210 provided in a lower region of the inner lens 200; and a second inner lens 220 which is provided above the first inner lens 210 and provided in close contact with the first inner lens 210. More preferably, the inner lens 200 may have a structure in which the first inner lens 210 and the second inner lens 220 are stacked while the first inner lens 210 and the second inner lens 220 lie in the horizontal direction. Also, more preferably, the second inner lens 220 may be provided at the same height as the light source 100. thus, the light, which is emitted from the light source 100 and moves in the horizontal direction, arrives at the rear side surface of the second inner lens 220. Then, the light may be incident into the second inner lens 220.

Here, according to the present disclosure, the first lighting image described above may be formed by light A which, among the light emitted from the light source 100, is incident into the second inner lens 220 through one side surface (for example, the rear side surface) of the second inner lens 220 and then emitted out through the other side surface (for example, the front side surface) of the second inner lens 220 on the opposite side from the one side surface. Also, according to the present disclosure, the second lighting image described above may be formed by light B which, among the light emitted from the light source 100, is incident into the second inner lens 220 through the one side surface (for example, the rear side surface) of the second inner lens 220 and then emitted out through a top surface of the second inner lens 220. That is, according to the present disclosure, the first lighting image may be formed by the light which, among the light emitted from the light source 100 and then incident into the second inner lens 220, is emitted out through the front side surface of the second inner lens 220. Also, the second lighting image may be formed by the light which is emitted out through the top surface of the second inner lens 220.

Meanwhile, according to the present disclosure, the second inner lens 220 may be a lenticular lens. The lenticular lens may be a special type of lens manufactured such that an image is changed depending on an angle at which the lens is viewed from the outside. The description of the detailed structure and principle of the lenticular lens will be substituted by the description of a lenticular lens known from the related art.

According to the present disclosure, when the second inner lens 220 is a lenticular lens, different lighting images may be produced depending on viewing angles. In particular, when the second inner lens 220 is a lenticular lens and lies in the horizontal direction, a 2D-shaped lighting image having uniform images for each of regions may be produced by the light emitted through the front side surface of the lenticular lens, and a 3D-shaped lighting image having stereoscopic images may be produced by the light emitted through the top surface of the lenticular lens.

Meanwhile, the first inner lens 210 may be a component for increasing optical efficiency of the lamp 10 in a manner in which, among the light emitted from the light source 100 and incident into the second inner lens 220, the light emitted through the bottom surface of the second inner lens 220 is reflected from the first inner lens 210 and supplied to the second inner lens 220 again. To this end, additional physical or chemical surface treatment may be performed on the top surface of the first inner lens 210.

Continuing to refer to FIG. 1, the lamp 10 according to the present disclosure may further include a support member 300 for fixing and supporting the inner lens 200.

More specifically, the support member 300 may include a first support member 310 which is provided below the first inner lens 210 and provided in close contact with the first inner lens 210.

Meanwhile, the first inner lens 210 may include: a body portion which constitutes a body of the first inner lens 210 and is in direct contact with the second inner lens 220; and a downward protruding portion 212 provided at a front end of the body portion and protruding downward. Here, as illustrated in FIG. 1, the front end of the first support member 310 may be provided in close contact with the rear surface of the downward protruding portion 212. Thus, according to the present disclosure, the rearward movement of the first inner lens 210 may be prevented by the interference between the first support member 310 and the first inner lens 210. More preferably, a rearward protruding portion 216 protruding rearward may be provided at a lower end of the downward protruding portion 212 of the first inner lens 210, and the first support member 310 may be provided above the rearward protruding portion 216. Thus, the upward movement of the first inner lens 210 may be prevented by the interference between the rearward protruding portion 216 and the first support member 310.

Also, the first inner lens 210 may further include a forward protruding portion 214 which is provided on the front surface of the downward protruding portion 212 and protrudes forward. Also, the support member 300 may further include a second support member 320 provided below the first support member 310, and at least a partial region of the second support member 320 may be provided in close contact with the forward protruding portion 214. More specifically, the second support member 320 may be provided in close contact with the front surface and the top surface of the forward protruding portion 214. Thus, according to the present disclosure, the forward movement of the first inner lens 210 may be prevented by the interference between the second support member 320 and the first inner lens 210. Meanwhile, more preferably, the second support member 320 may also be provided in close contact with the front surface of the downward protruding portion 212.

Meanwhile, according to the present disclosure, the top surface of the first inner lens 210 may be bonded to the bottom surface of the second inner lens 220. The bonding may be performed in various ways, and as one example, the top surface of the first inner lens 210 may be bonded to the bottom surface of the second inner lens 220 by a double-sided tape.

Also, both ends of the first inner lens 210 in the horizontal direction may cover a portion of both side surfaces and a portion of a top surface of the second inner lens 220. For example, both the side surfaces of the first inner lens 210 in the horizontal direction may be provided in a direction going into the page of FIG. 1 and in a direction coming out of the page of FIG. 1 so as to cover a portion of both the side surfaces and a portion of the top surface of the second inner lens 220. As described above, the first inner lens 210 is bonded to the second inner lens 220, and the first inner lens 210 is provided to cover the second inner lens 220. Thus, the adhesion between the first inner lens 210 and the second inner lens 220 may be enhanced.

Meanwhile, as illustrated in FIG. 1, the lamp 10 may further include a reflector 400 provided above the second inner lens 220. Here, a rear end of the second inner lens 220 may be inserted into a space formed between a rear end of the reflector 400 and a rear end of the first inner lens 210. More preferably, the first inner lens 210 may further include an upward protruding portion 218 which is provided at the rear end of the first inner lens 210 and protrudes upward toward the reflector 400, and the second inner lens 220 may be provided in close contact with a front surface of the upward protruding portion 218.

Figure 2:
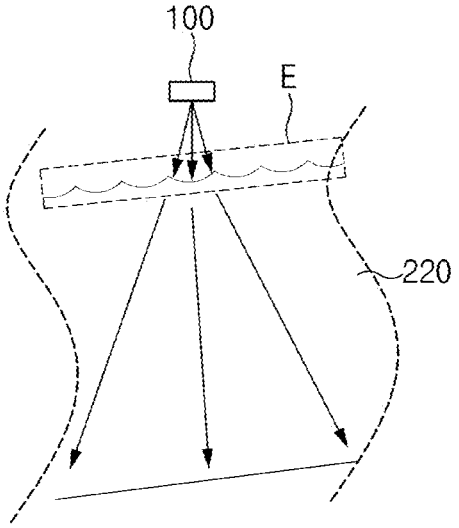
FIG. 2 is a cross-sectional view showing a travel direction of light for one example of a light input portion of a second inner lens in a lamp for an automobile according to the present disclosure.
Figure 3:
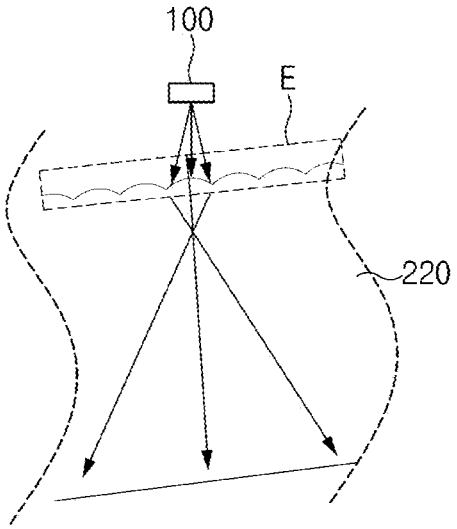
FIG. 3 is a cross-sectional view showing a travel direction of light for another example of the light input portion of the second inner lens in the lamp for an automobile according to the present disclosure.

FIG. 2 is a cross-sectional view showing a travel direction of light for one example of a light input portion of a second inner lens in a lamp for an automobile according to the present disclosure, and FIG. 3 is a cross-sectional view showing a travel direction of light for another example of the light input portion of the second inner lens in the lamp for an automobile according to the present disclosure.

Meanwhile, according to the present disclosure, the second inner lens 220 may include a light input portion E (that is, a rear side surface) which is one side surface facing the light source 100. Here, according to the present disclosure, the light input portion E may include a plurality of concave regions as illustrated in FIG. 2 so that the light emitted from the light source 100 is diffused. On the contrary, according to the present disclosure, the light input portion E may also include a plurality of convex regions as illustrated in FIG. 3 so that the light emitted from the light source 100 is converged and then diffused. When the light input portion E includes the concave regions or the convex regions, the light incident through the light input portion E may be spread uniformly in all directions. Thus, the lighting image having uniform luminous intensity may be produced.

Continuous to refer to FIG. 1, the lamp 10 according to the present disclosure may further include: a bezel part 500 that faces a front end of the reflector 400; a case 600 that has an open front and accommodates the light source 100, the inner lens 200, the support member 300, and reflector 400; and an outer lens 700 coupled to the front of the case 600.

Automobile

Referring to FIG. 1, an automobile according to the present disclosure may include a lamp 10 for an automobile (hereinafter, referred to as a 'lamp'). Here, the lamp 10 may include: a light source 100 emitting light; and an inner lens 200 having one surface that faces the light source 100. Also, the inner lens 200 may be disposed in a horizontal direction such that main planes of the inner lens 200 having large areas face upward and downward, and the light source 100 may face one side surface of the inner lens 200 in the horizontal direction.

Here, according to the present disclosure, among the light emitted from the light source 100, light, which is incident into the inner lens 200 through the one side surface of the inner lens 200 and then emitted out through the other side surface of the inner lens 200 on the opposite side from the one side surface, may form a first lighting image. Also, among the light emitted from the light source 100, light, which is incident into the inner lens 200 through the one side surface of the inner lens 200 and then emitted out through an upward facing main plane of the main planes of the inner lens 200, may form a second lighting image having a shape different from that of the first lighting image. Also, the lamp 10 according to the present disclosure may be a rear lamp provided on the rear of the automobile.

According to the present disclosure, provided is the lamp for an automobile, capable of producing the lighting image having the 3D shape more effectively than in the related art.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp for an automobile, the lamp comprising:

a light source configured to emit light; and an inner lens having one surface that faces the light source and comprising a first inner lens provided in a lower region of the inner lens and a second inner lens provided above the first inner lens and in close contact with the first inner lens, wherein the inner lens is disposed in a horizontal direction such that main planes of the inner lens having large areas face upward and downward, and the light source faces one side surface of the inner lens in the horizontal direction, wherein, among the light emitted from the light source, light, which is incident into the inner lens through the one side surface of the inner lens and then emitted out through another side surface of the inner lens on an opposite side from the one side surface, forms a first lighting image, wherein, among the light emitted from the light source, light, which is incident into the inner lens through the one side surface of the inner lens and then emitted out through an upward facing main plane of the main planes of the inner lens, forms a second lighting image having a shape different from that of the first lighting image, wherein the first lighting image is formed by light which, among the light emitted from the light source, is incident into the second inner lens through one side surface of the second inner lens and then emitted out through another side surface of the second inner lens on the opposite side from the one side surface.

2. The lamp of claim 1, wherein the first lighting image has a 2D image, and the second lighting image has a 3D image.

3. The lamp of claim 1, wherein the second lighting image is formed by light which, among the light emitted from the light source, is incident into the second inner lens through the one side surface of the second inner lens and then emitted out through a top surface of the second inner lens.

4. The lamp of claim 1, wherein the second inner lens is a lenticular lens.

5. The lamp of claim 1, further comprising a first support member which is provided below the first inner lens and provided in close contact with the first inner lens.

6. The lamp of claim 5, wherein the first inner lens comprises:

a body portion constituting a body of the first inner lens; and a downward protruding portion which is provided at a front end of the body portion and protrudes downward, wherein a front end of the first support member is provided in close contact with a rear surface of the downward protruding portion.

7. The lamp of claim 6, wherein the first inner lens further comprises a forward protruding portion which is provided on a front surface of the downward protruding portion and protrudes forward, wherein the lamp further comprises a second support member provided below the first support member, and at least a partial region of the second support member is provided in close contact with the forward protruding portion.

8. The lamp of claim 7, wherein the second support member is provided in close contact with a front surface and a top surface of the forward protruding portion.

9. The lamp of claim 8, wherein the second support member is provided in close contact with the front surface of the downward protruding portion.

10. The lamp of claim 1, wherein a top surface of the first inner lens is bonded to a bottom surface of the second inner lens.

11. The lamp of claim 10, wherein the top surface of the first inner lens is bonded to the bottom surface of the second inner lens by a double-sided tape.

12. The lamp of claim 1, wherein both ends of the first inner lens in the horizontal direction cover a portion of both side surfaces and a portion of a top surface of the second inner lens.

13. The lamp of claim 1, further comprising a reflector provided above the second inner lens, wherein a rear end of the second inner lens is inserted into a space formed between a rear end of the reflector and a rear end of the first inner lens.

14. The lamp of claim 13, wherein the first inner lens further comprises an upward protruding portion which is provided at the rear end of the first inner lens and protrudes upward toward the reflector, wherein the second inner lens is provided in close contact with a front surface of the upward protruding portion.

15. The lamp of claim 1, wherein a light input portion, which is the one side surface of the second inner lens facing the light source, comprises a concave region so that the light emitted from the light source is diffused.

16. The lamp of claim 1, wherein a light input portion, which is the one side surface of the second inner lens facing the light source, comprises a convex region so that the light emitted from the light source is converged and then diffused.

17. An automobile comprising a lamp for the automobile, wherein the lamp comprises:

a light source configured to emit light; and an inner lens having one surface that faces the light source and comprising a first inner lens provided in a lower region of the inner lens and a second inner lens provided above the first inner lens and in close contact with the first inner lens, wherein the inner lens is disposed in a horizontal direction such that main planes of the inner lens having large areas face upward and downward, and the light source faces one side surface of the inner lens in the horizontal direction, wherein, among the light emitted from the light source, light, which is incident into the inner lens through the one side surface of the inner lens and then emitted out through another side surface of the inner lens on an opposite side from the one side surface, forms a first lighting image, wherein, among the light emitted from the light source, light, which is incident into the inner lens through the one side surface of the inner lens and then emitted out through an upward facing main plane of the main planes of the inner lens, forms a second lighting image having a shape different from that of the first lighting image, wherein the first lighting image is formed by light which, among the light emitted from the light source, is incident into the second inner lens through one side surface of the second inner lens and then emitted out through another side surface of the second inner lens on the opposite side from the one side surface.

18. The automobile of claim 17, wherein the lamp is provided on a rear of the automobile.

* * * * *